US005193648A

United States Patent [19]

Yuter

[11] Patent Number: 5,193,648

[45] Date of Patent: Mar. 16, 1993

[54] RESTAURANT CONSTRUCTION SYSTEM

[76] Inventor: Seymour C. Yuter, 407 Cedar Dr. West, Briarcliff Manor, N.Y. 10510

[21] Appl. No.: 705,126

[22] Filed: May 24, 1991

[51] Int. Cl.[5] ..... E04H 3/04

[52] U.S. Cl. ..... 186/38; 52/236.7

[58] Field of Search ..... 186/35, 36, 38-51, 186/53; 52/106, 236.3, 236.7, 65, 6, 8-10, 33, 36, 73

[56] References Cited

U.S. PATENT DOCUMENTS

| | | | |
|---|---|---|---|
| 1,379,610 | 5/1921 | Bartholomew | 52/106 |
| 1,459,628 | 6/1923 | Hockaday | 186/41 X |
| 2,405,294 | 8/1946 | Delucchi | 186/41 |
| 3,641,263 | 2/1972 | Rhoads et al. | 186/49 X |
| 4,074,793 | 2/1978 | Yuter | 186/38 |
| 4,184,050 | 1/1980 | Yuter | 52/36 X |
| 4,306,388 | 12/1981 | Yuter | 186/35 X |
| 4,518,821 | 5/1985 | Yuter | 379/172 |
| 4,553,222 | 11/1985 | Kurland et al. | 186/38 X |
| 4,694,486 | 9/1987 | Yuter | 379/110 |
| 4,800,438 | 1/1989 | Yuter | 379/53 X |

FOREIGN PATENT DOCUMENTS

| | | | |
|---|---|---|---|
| 2479313 | 10/1981 | France | 52/65 |

*Primary Examiner*—F. J. Bartuska

*Attorney, Agent, or Firm*—S. C. Yuter

[57] ABSTRACT

A restaurant construction system comprising a building having a first floor. A second floor consists of a terrace on three sides of the building forming an atrium between the terrace and the fourth side of the building. Both floors have dining tables and chairs with a telephone on a console on each table. An order-taking post is supported along the fourth side of the building slightly higher than the second floor terrace level and extends into the atrium so that substantially all of the tables on the first floor including those beneath the terrace as well as substantially all of the tables on the terrace can be seen. Thus an order-taking person with a telephone in the order-taking post can see a patron at any of the tables while taking his or her order over the phone, and enter the order on an input terminal of a fine dining restaurant computer system. The bar is positioned below the order-taking post. An outward extension of the fourth side of the building along the order-taking post permits a person in the order-taking post to identify patrons at the entrance. A video camera mounted on the outside of the fourth side of the building views the license plates of cars at the entrance of the restaurant, with its video display at the order-taking post.

44 Claims, 3 Drawing Sheets

RESTAURANT CONSTRUCTION SYSTEM

BACKGROUND OF THE INVENTION

1. Field of the Invention

This invention pertains to the construction of restaurants and more particularly to an improved restaurant construction system for more promptly and more personally serving a relatively large number of restaurant patrons.

2. Description of the Related Art

U.S. Pat. No. 4,074,793 issued to the present inventor on Feb. 21, 1978 for a Restaurant Dining System ("793 Patent"). It discloses a restaurant dining system comprising dining and bar areas, a cocktail lounge, a kitchen and a raised order-taking post separate from the dining and bar areas. The order-taking post facilitates the prompt delivery of food and drink orders taken by telephone from patrons in the dining area and cocktail lounge in visual communication with the order-taking person. That patent discloses a table on which a telephone is positioned with a speaker mounted beneath the table top. Patrons use the telephone to communicate their orders to a person in the order-taking post who transmits the orders to the service bar or kitchen. The speaker permits music to be played at the table.

The same disclosure as the 793 Patent is in U.S. Pat. No. 4,184,050 issued to the present inventor on Jan. 15, 1980 for a Drink Service System, particularly for a bar noise control feature. The same disclosure is also in U.S. Pat. No. 4,306,388 issued to the present inventor on Dec. 22, 1981 for a Restaurant Entertainment System, particularly for a combined piano bar-bandstand which straddles the bar area and dance floor.

U.S. Pat. No. 4,518,821 issued to the present inventor on May 21, 1985 for a Restaurant Telephone Entertainment System ("821 Patent"). It discloses a combined telephone-speaker-lamp console for use on tables in a restaurant having a telephone ordering system of the type disclosed in the 793 Patent. The lamp blinks in response to telephone ringing current fed to the associated telephone. Each console has a cable of sufficient length to extend via a hole in the table supporting the console through a pedestal and past the pedestal's base to be plugged into the central cable system that runs under the carpeting and then be retracted beneath the base.

The same disclosure as the 821 Patent is in U.S. Pat. No. 4,694,486 issued to the present inventor on Sep. 15, 1987 for a Combined Telephone-Table System, particularly the cable retraction feature.

U.S. Pat. No. 4,800,438 issued to the present inventor on Jan. 24, 1989 for a Telephone Console for Restaurant Tables ("438 Patent"). It discloses an improved restaurant telephone console comprising a chassis mounted on a pipe support extending above a table. A lampshade support has a downwardly-extending side wall which goes over the chassis. A telephone is mounted on the top panel of the lampshade support. Other components—including a speaker, lamp bulbs, a chime and a pocket color TV set—are mounted on the chassis beneath the lampshade support. The lamp bulbs illuminate a portion of the table around the console. The patent also discloses a schematic electrical diagram of the console control system and associated audio and video components used to operate the console, and an alarm system to prevent theft of the phone.

The 793 Patent has dining table seating on one level with each seat in view of the raised order-taking post so that the order-taking person can see the patron while taking the patron's order. That visual contact is deemed by the inventor to be a very important feature of the restaurant dining system in order to provide a personal touch between the two. To expand the number of seats on the same level requires a corresponding increase in the base or footprint of the restaurant with a corresponding increase in construction and land occupancy cost. Moreover, the longer the distance between the order-taking post and the patron's table, the less personal is the visual contact, which is undesirable.

However, if a second floor is provided when constructing the restaurant to expand the number of seats on the same footprint and thus the profit, then an additional order-taking post is required for the second floor. That is undesirable because just a small overflow of patrons from the first floor would require an additional order-taking person for the second floor, and also some duplication of equipment would be required at increased capital cost.

BRIEF SUMMARY OF THE INVENTION

A general object of the invention is to provide an improved restaurant construction system in which a patron's food and beverage orders are taken over the phone while the order-taking person is in visual contact with the patron.

Another object of the invention is to substantially expand the number of seats in the restaurant at a relatively low increase in construction cost.

A specific object of the invention is to substantially expand the number of seats in the restaurant on the same footprint without having to add an additional order-taking post.

A further object of the invention is to increase the personal touch between the restaurant personnel and the patrons.

Briefly, in accordance with the invention, a restaurant construction system is provided comprising a building having a first floor with a plurality of dining tables and chairs and with a telephone at each table, and a second floor consisting of a terrace on three sides of the building forming an atrium between the terrace and the fourth side of the building and also having a plurality of dining tables and chairs with a telephone at each table. An order-taking post is supported along the fourth side of the building and extending into the atrium and positioned to see substantially all of the tables on the first floor including those beneath the terrace as well as substantially all of the tables on the terrace. Thus an order-taking person with a telephone in the order-taking post can see a patron at any of the tables while taking his or her order over the phone.

A principle feature of the invention is an outward extension of the fourth and front side of the building along the order-taking post so that a person in the order-taking post can identify previously known patrons at the entrance to the restaurant. Thus an identified entering patron can be greeted by their name by the restaurant receptionist when their name is telephoned from the order-taking post.

Another feature of the invention is positioning the bar below the order-taking post to use floor space not in full view of the order-taking post and thus not useful for tables, and also along the outward extension of the fourth and front side of the building so that patrons at the bar can see other patrons entering the restaurant.

A further feature of the invention is a video camera mounted on the outside of the fourth and front side of the building and positioned to view entering patrons as well as the license plates of cars at the entrance of the restaurant, with its video display at the order-taking post. A computer lookup system is provided to identify a patron from his or her car's license number so that an identified entering patron can be greeted by their name by the restaurant receptionist when telephoned from the order-taking post.

A still further feature of the invention is a porte cochere extending from the entrance to confine patrons' cars in an area so that their license plates are in view of the video camera.

Still another feature of the invention is a computer system with a stored data base having the names of past patrons, any preferred table location and the last drink they ordered so that an order-taking person can greet an identified patron, seated at their preferred table if available, and immediately ask if they are having their usual drink.

An advantage of these features of the invention is that patrons are treated more personally than at most restaurants because past patrons are addressed by their names when they enter and complimented by the receptionist knowing their preferred table and the order-taking person knowing what they usually drink.

A still further feature of the invention is a connecting walkway from the terrace to the order-taking post to provide easy access to the order-taking post.

Yet another feature of the invention is a see-through floating stairway between the first and terrace floors so that order-taking persons in the order-taking post can see through the stairway to talk on the phone to patrons seated beyond the stairway.

Yet a further feature of the invention is another stairway between the first and terrace floors which is enclosed in order to also function as part of the checking facility for the storage of hats and coats.

Yet a still further feature of the invention is to use floor space for a food buffet bar which is readily removed in order to use the same floor space as a dance floor.

Still another feature of the invention is central control from the order-taking post of various electrical, audio, video, computer and environmental control systems.

BRIEF DESCRIPTION OF THE DRAWINGS

Other objects, features and advantages of the invention will be apparent from the following Description of the Preferred Embodiment taken together with the accompanying drawings in which.

DESCRIPTION OF THE PREFERRED EMBODIMENT

Figure 1:
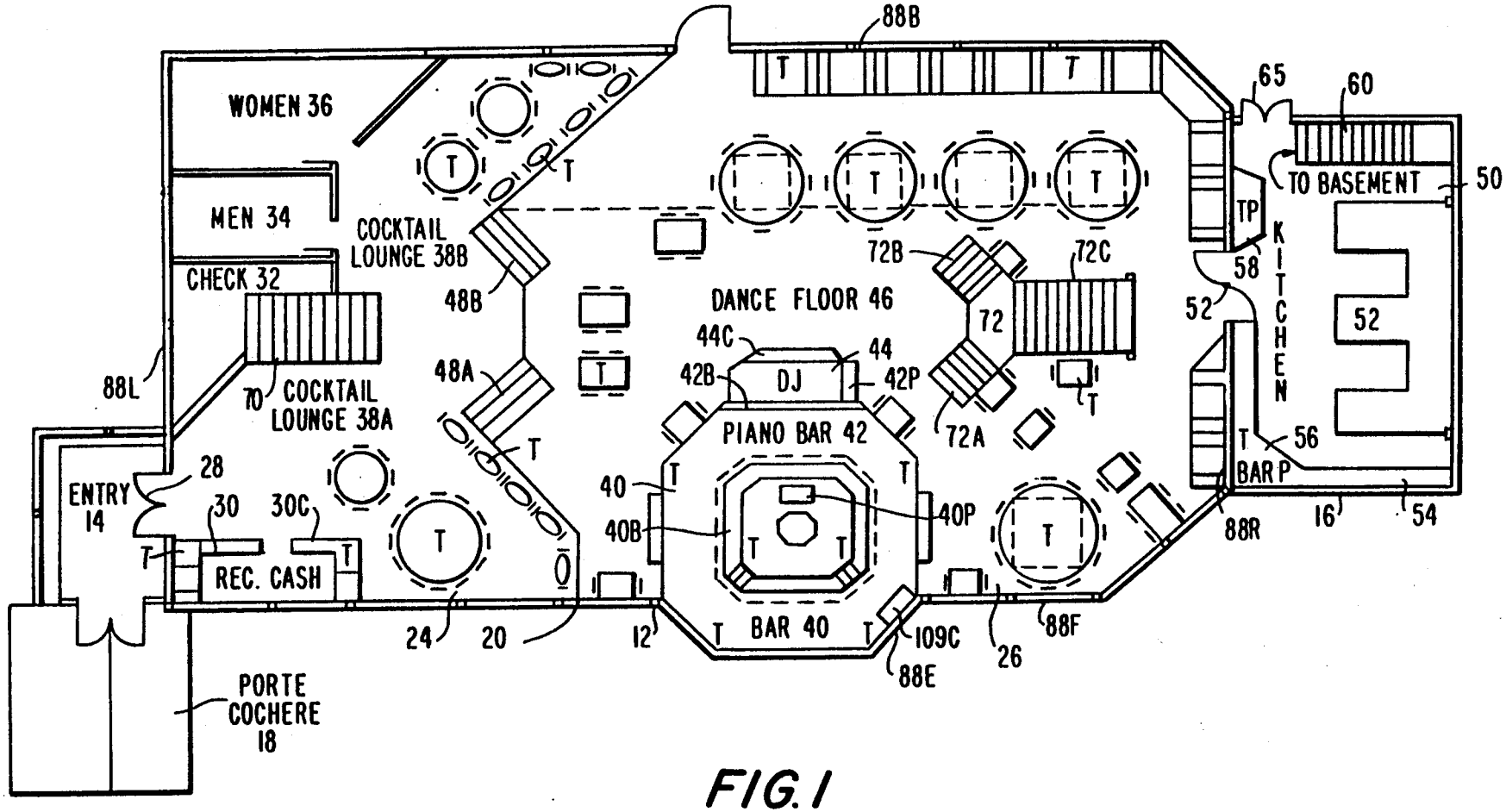
FIG. 1 is a schematic diagram of the first floor of a restaurant construction system in accordance with the preferred embodiment of the invention, and showing the outwardly extending bar which provides a view from the bar of entering patrons at the porte cochere, the see-through floating stairway on the right and the enclosed hat and coat storage stairway on the left.

Referring to FIGS. 1, 2 and 3A–3B of the drawings, a restaurant construction system 10 is shown consisting of a central building 12, an entry 14 at the left side and a kitchen 16 at the right side. A porte cochere 18 extends from the entry 14.

The central building 12 has a first floor 20 (FIG. 1) and a second floor 22 (FIG. 2), which together with the entry 14 comprise the public part of the restaurant.

The first floor 20 (FIG. 1) consists of the entry level 24 and the lower level 26. Entry level 24 has entrance doors 28 accessing entry 14, a reception desk 30, a cashier's desk 30C, a check room 32, a men's room 34, a women's room 36 and cocktail lounges 38A and 38B. Lower level 26 includes a raised bar 40 and a combined piano bar 42 and disc jockey stage 44 with an adjacent dance floor 46.

Telephones are designated by the letter "T" on some of the tables although each table has a telephone with some at the bar 40.

Entry level 24 is connected to lower level 26 via stairs 48 and 48B. Lower level 26 accesses the first floor 50 of a 3-floor kitchen 16 via swinging doors 52.

The bar 40 is octagonal in shape so that patrons can walk around the central bar section 40B. Seats are shown by short dashes. The floor of bar 40 is two steps (about 15 inches) above the floor of the lower level 26 of the first floor 20. The floor of disc jockey stage 44 is one step (about 7½ inches) above the floor of the lower level 26 of the first floor 20.

The piano bar 42 consists of bar 42B and piano 42P. The disc jockey is preferably also a pianist. The disc jockey stage 44 has a counter 44C with a microphone and record, tape, compact disc and audio and video cassette players. Alternatively, live musicians can play from stage 44. Not shown is dance floor lighting controls within reach of the disc jockey.

The first floor 50 of kitchen 16 includes the food preparation and cooking area 52, the dish and pot washing area 54, a service bar 56 and a kitchen manager's table 58. A kitchen stairs 60 connects the first floor 50 to the second floor 64 (FIG. 2) of the kitchen 16. Below the first floor 50 (FIG. 1) is a basement (not shown) for storage and dressing facilities, accessed by a stairs (not shown) beneath kitchen stairs 60. Doors 65 provide access to first floor 50 for the entrance of restaurant personnel and deliveries.

Stairs 70 adjacent the check room 32 are connected to the second floor 22. At the kitchen end of lower level 26 are stairs 72 also connected to the second floor 22.

Stairs 70 are enclosed to provide additional storage space under the stairs for the storage of hats and coats which are checked by patrons at the check room 32.

Stairs 72 comprises lower stairs 72A and 72B and upper stairs 72C.

Stairs 72 are constructed as a floating stairway with its steps supported by a longitudinal steel beam laterally centered along the steps. The vertical spaces between its steps are free and clear except for the steel beam and lateral steel step supports connected to the steel beam. Thus tables on the far side of stairs 70 can be seen from the captains' tower 82.

The second floor 22 (FIG. 2) consists of a second floor terrace 80, an order-taking post or captains' tower 82 and a second floor kitchen 84. The terrace 80 is supported from side walls 88L, 88R and 88B of the central building 12 of restaurant construction system 10 and forms an atrium 86 between terrace 80 and the fourth side wall 88F of central building 12. By constructing the restaurant with two levels, and with substantially all of the tables in view of the tower 82, there is an expansion of the total number of seats in the restaurant without a substantially more expensive expansion of the footprint occupied by the building.

The terrace 80 accesses the kitchen 84 via swinging doors 85.

The captains' tower 82 is supported along an outward extension 88E in fourth side wall 88F with its floor height two steps higher (about 15 inches) than the floor of terrace 80. Tower 82 is connected to terrace 80 by steps 92 and walkway 94 comprising an easy runway access between the terrace 80 and tower 82. A skylight 95 (FIGS. 3A and 3B) is constructed in the roof 97 of building 12 directly over tower 82. The area of roof 97 above atrium 86 (FIG. 2) may also be constructed as a skylight.

The captains' tower 82 (FIG. 3B) is positioned directly above bar 40, which also extends into outward extension 88E (FIG. 1) of sidewall 88F. Placing bar 40 beneath tower 82 uses floor space that is out of easy view of captains in the tower 82 and thus not suitable for tables. Patrons in the left portion of the bar 40 which extends into outward extension 88E can see patrons entering the restaurant at the entry 14 as well as patrons' cars at the porte cochere 18.

Dance floor lighting 99 (FIG. 2) is mounted on the outside of the inside end of tower 82 and is under control of lighting controls (not shown) at the tower 82 and the disc jockey stage 44.

The terrace 80 has a bar 96 at its left end and a bar 98 at its right end. Bar stools 99A are positioned along a counter 99B mounted on the inside of sidewall 88B between bars 96 and 98.

A combined buffet-dance floor 101 is in front of bar 96 and an additional buffet 103 is positioned along the inside of sidewall 88L. For lunch, buffet 101 contains the appetizers and entrees and buffet 103 the desserts and beverages. After lunch and before the happy hour, the buffet 101 is removed to open up the dance floor 101. Then buffet 103 is used for the happy hour free food bar.

Second floor kitchen 84 consists of food preparation area 100, assistant kitchen manager desk 102, a service bar 104 and offices 106. The service bar 104 has a window access 108 to bar 98. The offices 106 are for the management personnel of the restaurant.

Kitchen 84 supplies the terrace 80 and cocktail lounges 38 (FIG. 1) with snacking foods and supplements the first floor 50 of kitchen 16 at lunch and dinner.

The areas 105L and 105R of second floor terrace 80 along the front left and right sides of second floor 22 are for use by private parties. Each party area 105 is separated from the remaining terrace 80 by a variably-translucent partition 107L and 107R, disclosed in the 793 Patent's FIG. 8 and associated description, hereby incorporated by reference. Each translucent partition 107 is made of a transparent acrylic plastic panel of the Lucite or Plexiglas. They are colorless and crystal clear with a high coefficient of light transmission and little absorption of the light passing through. The panels function to pipe light introduced by lamps at their lower edges. The light leaves the panel at frosted or roughened surfaces, which can include the restaurant's logo or other design. Accordingly, by controlling the amount of light from the lamps, the variably-translucent panel can operate either as a visually separating partition or, with no light, as a substantially transparent partition. The amount of light from the lamps is controlled by variable voltage source panel 107C at the captains' tower 82.

Figure 2:
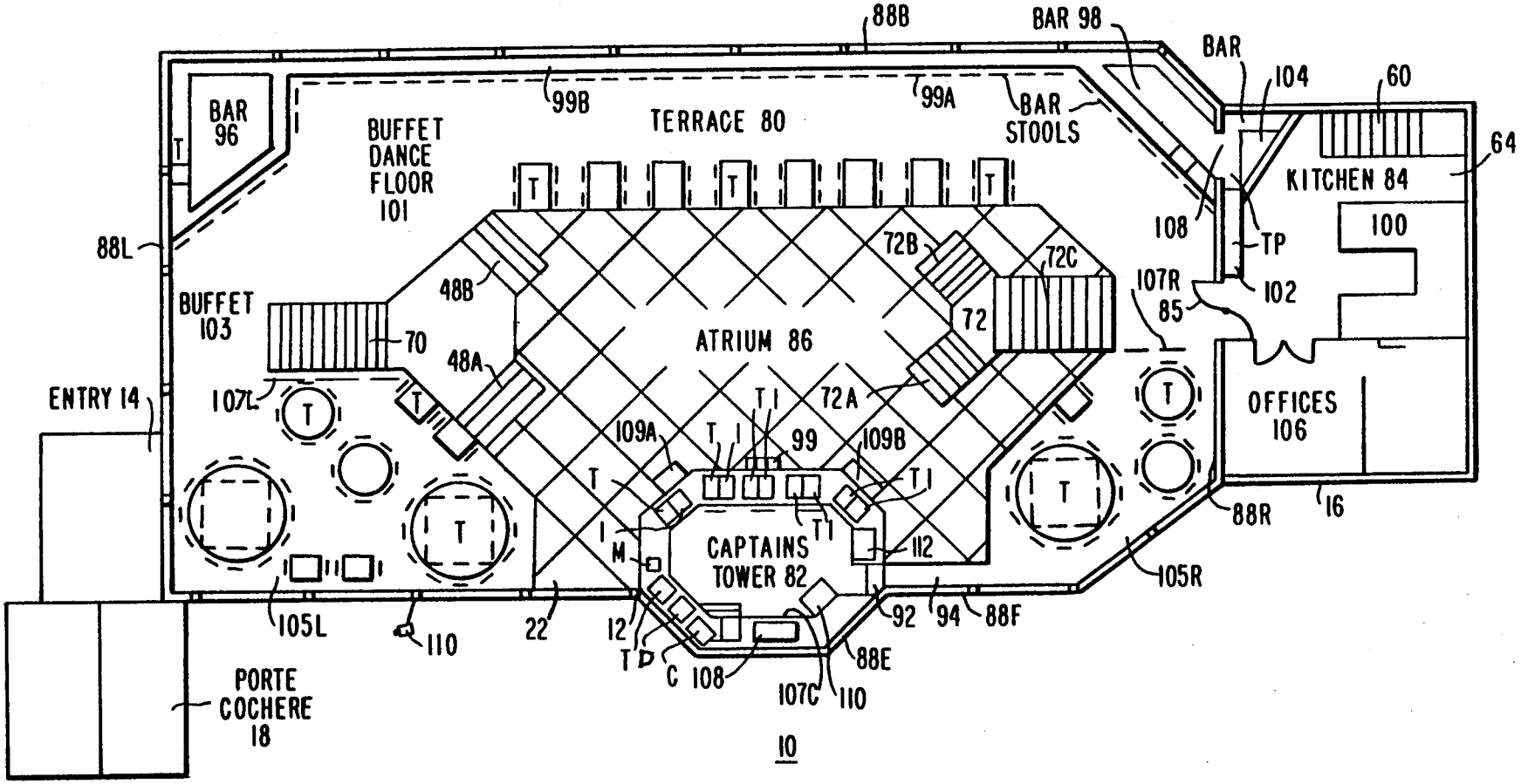
FIG. 2 is a schematic diagram of the second floor of the restaurant construction system showing the terrace and atrium with the order-taking post (captains' tower) extending into the atrium and outwardly from the adjacent wall of the building to provide a view of entering patrons and their cars under the porte cochere, the easy runway access from the terrace to the order-taking post and the convertible buffet and dance floor.

The first and second floors of the restaurant are provided with tables and chairs as shown in FIGS. 1 and 2. Chairs are shown by short dashed lines. On each table is a telephone console T, shown on some of the tables, except for booths and tables along walls, where the telephone consoles are wall mounted.

A suitable telephone console T is described in the 438 Patent, whose disclosure is hereby incorporated by reference. Each telephone console T comprises a telephone on top of a translucent plastic lamp shade, with lamps and speakers beneath the lamp shade out of sight, and a small video screen mounted in the side wall of the lamp shade. A pushbutton switch permits selection of different audio and video inputs. Audio and lamp controls control the audio volume and light levels. Table supported telephone consoles are mounted above the table surface so as to illuminate the table and provide room for salt, pepper and sugar dispensers. Each telephone console also includes one of a plurality of different melodious chimes, of the type used in automobiles to signal that a door is open. Adjacent tables have different chimes so that a patron can tell when their own table phone is ringing, which is confirmed by their lamp and speaker music turning off during the presence of ringing current. Each telephone also has a speakerphone and activating button for hands-off conversation.

Adjacent tables also have different telephone colors to help restaurant personnel direct service to specific tables; for example by floor captains, bus persons and servers who carry belt-mounted portable telephones with headsets which can be called by a captain in the captains' tower 82.

A multi-channel audio-video system 108 at the captains' tower 82 feeds audio and video signals to each table and wall consoles for daily food and drink specials, background and dance music and the audio of major TV events, live entertainment, fashion shows, lectures and telephone talk shows. The audio-video system 108 includes a video camera focused on a card displaying the daily specials to generate the daily specials video signal.

Giant screen TVs 109A and 109B are mounted on the left and right front of the captains' tower 82 and display the daily food and drink specials, major TV events and enhance the disc jockey's dance music. Another giant screen TV 109C is mounted in the bar 40.

As described in the 493 Patent, whose disclosure is hereby incorporated by reference, console cables run beneath the floor carpeting and exit beneath the base of each table to plug into the console's cable and then be retracted beneath the base. The carpet is preferably in rectangular sections which are adhered to the floor using a pressure sensitive adhesive which permits repeated separation and adhering so that a cable can exit between separated carpet sections. Moreover, a table can be moved to a nearby position and its cable readily reoriented beneath the liftable carpet sections to exit beneath the new location of the table base.

Food and beverage orders are taken by telephone from captains seated in the captains' tower 82 (FIG. 2) in view of patrons at the tables. At each captains' position is a telephone switchboard T (in a square), and the input terminal I of a fine dining restaurant computer system.

A computerized telephone billing system 110 at the captains' tower 82 keeps track of patrons' telephone calls and computes the charges to be added to the patron's checks. It can be a typical hotel telephone computer billing system which provides a printout for all guest telephone charges.

The restaurant computer system is a fine dining system such as the NCR 2760 System manufactured by NCR Corporation. The NCR 2760 System is described in greater detail at the end of the specification.

Input terminals I are also at the bar 40 (FIG. 1) and the bars 96 and 98 (FIG. 2) to enter food and beverage orders from patrons not at tables.

By putting the captains' tower 82 as far from the terrace 80 as reasonably possible, captains can see all of the tables under the terrace 80 on the lower level 26 (FIG. 1) and in the cocktail lounges 38 on the entry level 24 of the first floor 20, as well as those in the atrium 86 and on the terrace 80 (FIG. 2). By providing the tower 82 floor to be slightly higher than the floor of the terrace 80, captains can better view patrons at tables at the outer sides of terrace 80.

Figure 3A:
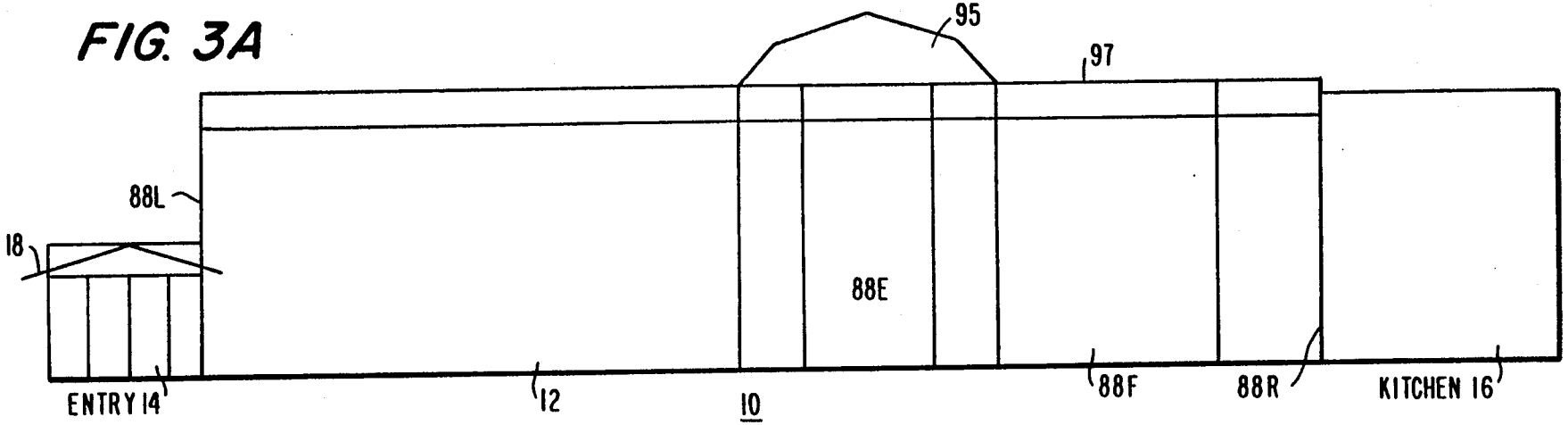
FIG. 3A is a front elevational view of the restaurant construction system showing the central office building-type construction of the restaurant with a removable entry at the left and a removable concrete block kitchen on the right.
Figure 3B:
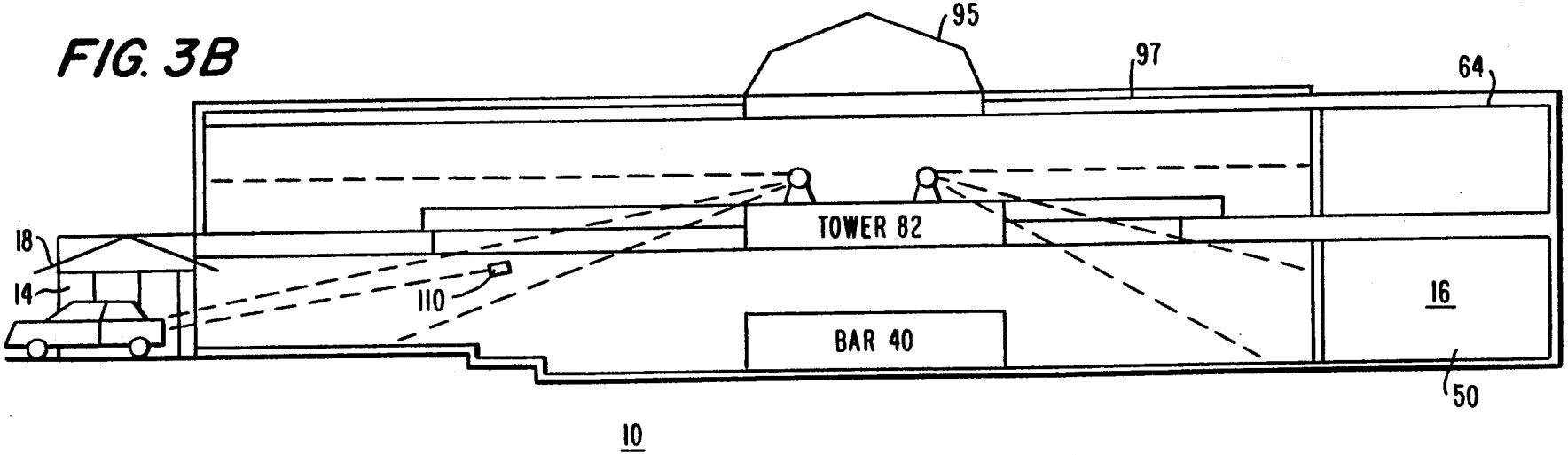
FIG. 3B is a front sectional view of the restaurant showing how persons in the captains' tower can view seated patrons on and beneath the terrace, patrons entering the restaurant at the porte cochere and the license plate numbers of their cars.

Alternatively, the tower 82 floor can be at the same level as the terrace 80 floor in order to increase the visibility of tables adjacent the sidewalls 88L, 88R and 88B beneath the terrace 80. FIG. 3B shows some of the sight lines between captains in the tower 82 and the inside and outside of the restaurant.

Floor captains with belt-mounted wireless telephones with headsets, so they are in instant telephone contact with other captains via a base station at the captains' tower 82, can also use hand-held ordering terminals for accessing the restaurant computer system directly from a patron's table which may be out of easy sight from the captains' tower 82. And also from persons on the terrace 80 at the counter 99B. The hand-held ordering terminals may be those of an NCR 2750 System manufactured by NCR Corporation. The NCR 2750 System is described in greater detail at the end of the specification.

Also at the captains' tower 82 is a personal computer C and a video display monitor D. The personal computer C can be the personal computer for the restaurant computer system or a backup personal computer. The video display monitor D is connected to a video camera 110 mounted on the outside of sidewall 88F and pointed at the driveway beneath porte cochere 18 to view both entering patrons and the license plates of patrons' cars (FIGS. 2 and 3B).

The personal computer C is preferably an IBM-compatible 386SX type with at least a 40 megabyte hard disk and a 3½ inch diskette drive, a monitor and a keyboard. Stored on the hard disc drive is a data base consisting of names of past patrons, the license numbers of their cars if known, their last drink orders and any preferred table locations. Also stored on the hard disc drive are past and future reservations for patrons, including cancellations and no shows to help fix the number of reservations for busy times.

At the reception desk 30 (FIG. 1) is another and similar personal computer C together with a telephone console T, for the receptionist to use via a local computer network system to directly access the data base in the captains' tower computer C for a patron's preferred table if the receptionist visually recognizes the arriving patron with the help of the reservations list. A third and similar networked personal computer is located in the offices 106 together with a journal printer of the fine dining computer system to print out reports.

The controls 112 of a standard computer-controlled environmental control and smoke removal system are also located at the captains' tower 82. That includes the controls for the HVAC (heating and air conditioning system) and heat exchangers for reclaiming heat from exhausted smoke laden air (not shown), and a standard smoke precipitator 40P mounted above the bar 40.

OPERATION

A patron entering the restaurant at the entry 14 (FIGS. 1 and 3B) is in view of an assistant manager seated in the portion of the captains' tower 82 at the outward extension 88E of the side wall 88F and adjacent the video display monitor D. That assistant manager has a list of the reservations. If the entering patron is visually recognized, his or her name is entered on the computer C keyboard to access the data base and display the last drink order and any preferred regular table. If the patron is not visually recognized and arrived in a car stopped beneath the port cochere 18, the license number of the car is displayed on the video display monitor so that it can be entered on the personal computer C keyboard to display that same data on the computer's monitor. The identity of the identified patron is then telephoned by the assistant manager via an adjacent telephone switchboard T to the receptionist who is then able to address the entering patron by name and, if available, offer the patron his or her regular table.

The receptionist then calls the assistant manager with that patron's assigned table number. The assistant manager then tells the captain in the tower 82 responsible for that table who the patron is and their last drink so that the captain can chime the table telephone as soon as the patron is seated using his or her switchboard T, address the patron by name and ask the patron whether he or she is having a favored drink. The patron's drink order is then entered on the captains' input terminal I and instantly printed on a receipt printer P (FIG. 1) at the service bar 56 in the first floor kitchen 50. At the same time the check printer at the input terminal prints the entry on that patron's check. The drink order is then filled and put on a tray with the drink order receipt to be delivered by a runner to the table number on the receipt.

The same procedure is followed for other patrons at the same table, who may communicate their orders directly on the phone or via another patron at the table who is using the phone, or via the speakerphone.

When the captain in the tower 82 responsible for that patron's table believes the patrons there are ready to place their food orders, the captain again chimes that patron's phone, enters the food order on the input terminal I which is then printed on a receipt printer P at the desk 58 of the kitchen manager in the first floor kitchen 50. At the same time the food order is added to that patron's check by the check printer at the input terminal I. The kitchen manager then assigns the order to the cooks, who prepare the order which is then placed on a tray together with the food order receipt. A runner then delivers the loaded tray to the table number on the receipt. The same procedure is followed for other patrons at the same table, who may communicate their orders directly on the phone or via another patron at the table, or via the speakerphone.

Whenever a table telephone console T is chimed its lamp and speaker music simultaneously turn off. Alternatively, if the restaurant manager believes the noise level is too high from table chimes, they can be turned off from the captains' tower and only a table's lamp and speaker will turn off when its phone is called and a telephone console lamp relay clicks.

When the patron calls the captain for the check, the captain completes it at his or her input terminal check printer and it is delivered to the patron for payment or charge by a floor captain. The captains in the captains' tower 82 take turns serving on the floor. Alternatively, the cashier at 30C can print out the check from terminal I.

The console telephones each store at least 12 automatic speed dialed numbers. They include the numbers for that table's captain, the manager, kitchen manager, cashier and telephone operator, so that a patron can call any of those people directly.

Thus, in accordance with the invention, very personal and prompt service is provided to patrons, especially those who have been to the restaurant before so that their names are in the personal computer data base.

Moreover, the table telephones permit patrons to be in ready touch with their offices, to make and receive calls from customers and, in the evening, to call or receive calls from baby sitters at home.

Another advantage of the telephones is for singles to make the acquaintance of other singles. When the DJ is playing dance music, one single can call another to see if they care to dance. Singles at the raised bar 40 can better see other singles on the first floor 20 whom they may wish to call. Or a single can call another single to converse.

The invention is especially useful for a telephone-theme restaurant designed to appeal primarily to business people and singles. Business people can be in touch with their businesses. Singles can be in touch with each other in a casual party ambiance. The restaurant can also cater to parties and dating couples, especially those who enjoy dancing.

Captains in eye contact with the patrons are constantly available for personal service. The consoles permit a captain to greet the patrons and take telephone orders. The orders can be immediately transmitted by the captains to the service bar or kitchen via the fine dining computer system. Runners promptly deliver the prepared food and drinks. (There are no waiter with assigned tables.)

The following description of how the invention works personally is from the viewpoint of patrons.

During business hours a business person will be able to make and receive outside local, long distance and international calls in addition to communicating within the restaurant. If a business person is at a breakfast, luncheon or dinner conference and needs to make or receive a business call; or his or her office or home or a customer needs to call; or he or she wants to access their office or other data base from a portable terminal; or send or receive a fax; or trade securities on a portable Quotron; or arrange a later activity—the business person is in handy telephone touch with the world via the table phone.

In the evening singles can sink into comfortable chairs in the cocktail lounge while awaiting their dining table. They can adjust the light and music volume to suit their mood. Their lamp blinks, the music stops and the phone chimes melodiously. The attentive captain in the service tower wants to know what they want to drink. In a surprisingly short time their drinks are on the table. And it is a good time to make that promised telephone call while being entertained by the subtle excitement of the scene.

The telephone-theme restaurant is also a dignified meeting place to make new friends. If in the mood, a single can initiate or receive requests via the phone to dance or just converse.

In the dining room the singles can study the menu and make their choices. Their lamp blinks. Another attentive captain is ready to take their order.

In the cocktail lounge the captain had asked a single if he or she would take a call from another person at a nearby table; should he give out your unlisted number? The single agreed, and there was an invitation to dance from an interesting stranger. During their meal the captain again asked if one of the singles would take a call. The single declined. They are in control.

The singles call for their check. It is delivered by their floor captain, who recommended and served the reasonably priced excellent wine. The check is completely itemized from the first drinks in the cocktail lounge to the after-dinner liqueurs and includes their local and long distance telephone charges.

The restaurant includes the following systems all integrated to work together and mainly under the control of persons in the captains' tower 82 which thus functions as a control tower:

(a) A telephone system with multiple central consoles at the control tower and multiple telephone table and wall consoles.

(b) A fine dining restaurant computer system with multiple order-taking terminals and remote printers.

(c) Networked personal computers to maintain reservation records and patrons' last drink orders, last or preferred table numbers and automobile license numbers.

(d) A computerized telephone billing system to keep track of patrons' telephone calls and compute the charges to be added to the patrons' checks.

(e) A multi-channel audio-video system which feeds audio signals to each table and wall consoles for daily food and drink specials, background and dance music and the audio of major TV events, live entertainment, fashion shows, lectures and telephone talk shows.

(f) Giant TV screens to display daily food and drink specials, major TV events and enhance the disc jockey's dance music.

(g) Dance floor lighting and control system.
(h) A combined piano bar and bandstand with supplemental disc jockey control of the audio-video, giant TV and dance floor lighting systems.
(i) Variably translucent partitions to separate private parties from the rest of the restaurant.
(j) Entering patrons monitoring system.
(k) A computer-controlled environmental control and smoke removal system.

The central building 12 (FIG. 3A) is constructed using well known office building construction techniques comprising a steel beam framework and glass and aluminum curtain walls. The entry 14 is constructed of glass and aluminum as used in the construction of green houses and sidewalk cafe enclosures. The kitchen 16 is constructed from concrete blocks on each of its four sides, thus including the connecting side to the central building 12, for added protection against the spread of a fire in the kitchen to the public area of the restaurant.

If the restaurant fails, the entry 14 and kitchen 16 may be removed and the bar 40 and captains' tower 82 replaced by a central entrance to provide an office building by constructing offices on the first floor 20 and the terrace 80 with the entrance accessing the atrium 86 and the stairs 70 and 72 accessing the terrace 80. The means for converting the restaurant into an office building are well known to those of ordinary skill in the building construction art.

The disclosures of U.S. Pat. Nos. 4,074,793, 4,518,821 and 4,800,438 are hereby incorporated by reference.

The preferred fine dining system, the NCR 2760 System, comprises point of sale input terminals on which orders are entered and checks printed on automatic forms number reader printers for bar coded checks, remote receipt printers, a journal printer, a central personal computer and printer and related equipment. A beverage order may be entered on an input terminal and printed out on a remote receipt printer in the service bar. Similarly, an entered food order is printed out on a remote receipt printer in the kitchen.

The system architecture of the NCR 2760 System is an open systems design consisting of intelligent, programmable terminals linked to industry standard manager workstations (the personal computers C). Each 2760 terminal is a "peer" terminal and contains all sales and financial data, including operator data for each point of sale terminal. one terminal is designated as a primary which acts like a "traffic cop" for the system. The primary terminal controls printer routing and transaction updating. If the primary fails, another terminal automatically assumes the role of primary with no operator intervention. Information can be retrieved from terminals in the system even if they are experiencing failure. Once the terminal comes back on-line, a database from the primary terminal is automatically loaded into the terminal. This virtually eliminates problems with lost data and the need for manager intervention when a terminal fails. The system is configured with compact, easily serviced terminals with 9 inch CRT screens using double width characters, 128 key micromotion keyboard and up to 1MB per terminal. Because the keyboard is fully programmable, numeric, menu items and function keys can be located anywhere on the keyboard. Preset keys add further to operator efficiency and promote pricing accuracy. Removable keyboard inserts for menu items and function key descriptions permit fast and easy change of menus. The keyboard also features keys to adjust speaker volume and tone, dim or brighten the operator display and operate the paper feed. The terminal also has two serial asynchronous ports and two OCIA (optically coupled interface adaptor) ports. Any key on the keyboard can be programmed to require supervisor intervention.

The NCR 2750 System has hand held terminals with an 80 key keypad, 56 keys for menu items, four levels for presets and additional price look ups together easy to change menus and color code keyboards. Its memory includes 96 KB ROM and 160 KB RAM. Transmission to a base station occurs only at total time instead of after each keystroke. It is about 10.5 ounces in weight. It has a liquid crystal display of 20 characters×2 lines for operator lead through and display.

Thus, in accordance with the invention, a restaurant construction system has been provided accomplishing all of the objects, and having the features and advantages specified at the beginning of this specification together with other features and advantages.

What is claimed is:

1. A restaurant construction system comprising:
(A) a building having a first floor;
(B) a first plurality of tables and chairs with a telephone at each table on said first floor;
(C) said building also having a second floor comprising a terrace supported along three sides of said building and directly over some of said first plurality of tables and chairs on said first floor, and forming an atrium between said terrace and the fourth side of said building;
(D) a second plurality of tables and chairs with a telephone at each table on said terrace; and
(E) an order-taking post supported along the fourth side of said building above said first floor and extending into said atrium;
(F) whereby an order-taking person in said order-taking post is in view of a plurality of tables on said first floor including those beneath said terrace, and also in view of a plurality of tables on said terrace, so that the order of a patron at a table on either said first floor or said terrace can be taken over the telephone from said order-taking post while the order-taking person is in view of the patron.

2. A restaurant construction system according to claim 1 further comprising a cooking area, with said order-taking post being separate from said cooking area, and wherein the floor of said order-taking post is higher than the floor of said second floor terrace.

3. A restaurant construction system according to claim 1 wherein said order-taking post is connected to said terrace for access from said terrace.

4. A restaurant construction system according to claim 2 wherein said order-taking post is connected to said terrace by a walkway.

5. A restaurant construction system according to claim 1 wherein the fourth side of said building along said order-taking post extends outwardly.

6. A restaurant construction system according to claim 1 further comprising an entry along the fourth side of said building.

7. A restaurant construction system according to claim 6 wherein the fourth side of said building along said order-taking post extends outwardly and said entry is in view of said order-taking post via said outward extension.

8. A restaurant construction system according to claim 6 further comprising a video camera supported along the fourth side of said building and positioned to view patron's at said entry, and a video display at said order-taking post coupled to said video camera for displaying patrons in view of said video camera.

9. A restaurant construction system according to claim 6 further comprising a video camera supported along the fourth side of said building and positioned to view patron's cars at said entry, and a video display at said order-taking post coupled to said video camera for displaying the license plates of patron's cars in view of said video camera.

10. A restaurant construction system according to claim 7 further comprising a computer system having a data base including the names of patrons and their car license numbers, whereby a person in said order-taking post who views the license number of a car of a patron at said entry can look up the name of that patron.

11. A restaurant construction system according to claim 9 further comprising a computer system having a data base including the names of patrons and their car license numbers, whereby a person in said order-taking post who views the license number of a car of a patron at said entry on said video display can enter the license number to lookup the name of that patron.

12. A restaurant construction system according to claim 11 wherein the data base of said computer system also includes the last drink order of prior patrons.

13. A restaurant construction system according to claim 1 further comprising a computer system having a data base including the names of past patrons and their last drink orders.

14. A restaurant construction system according to claim 1 further comprising a personal computer at said order-taking post having a data base including the names of patrons and their last drink orders, whereby a person in said order-taking post who knows the name of a patron can enter that name to look up the last drink order of that patron.

15. A restaurant construction system according to claim 1 further comprising a stairway connecting said first floor to said terrace and comprising spaces between its steps so that a person in said order-taking post can see through said stairway to a table beyond said stairway.

16. A restaurant construction system according to claim 1 further comprising:

(A) a check room on said first floor for storing hats and coats; and (B) a stairway connecting said first floor to said second floor adjacent to said check room whereby hats and coats can be stored beneath said stairway.

17. A restaurant construction system according to claim 16 further comprising an enclosure for enclosing the space beneath said stairway.

18. A restaurant construction system according to claim 1 further comprising a telephone system with at least one telephone switchboard at said order-taking post and said plurality of telephones on said tables.

19. A restaurant construction system according to claim 1 further comprising a fine dining restaurant computer system with an order-taking terminal at said order-taking post and a remote printer for printing orders taken on said order-taking terminal.

20. A restaurant construction system according to claim 1 further comprising a kitchen, a service bar and a fine dining restaurant computer system with a plurality of order-taking terminals at said order-taking post and a remote printer at each of said kitchen and service bar for printing orders taken on said order-taking terminal.

21. A restaurant construction system according to claim 19 further comprising a wireless hand-held order-taking terminal for taking orders of patrons and a base station adapted to receive said orders and feed them into said fine dining restaurant computer system.

22. A restaurant construction system according to claim 1 further comprising a personal computer at said order-taking post having a data base of reservation records.

23. A restaurant construction system according to claim 1 further comprising a computerized telephone billing system with its printer at said order-taking post to keep track of patrons' telephone calls and compute the charges to be added to patrons' checks.

24. A restaurant construction system according to claim 18 wherein each of said telephones is part of a table console which comprises a speaker, and further comprising a multi-channel audio system at said order-taking post which feed audio signals to the speaker of each of said table consoles.

25. A restaurant construction system according to claim 24 wherein said multi-channel audio system at said order-taking post feeds audio signals to the speaker of each of said table consoles comprising recorded daily food specials or music.

26. A restaurant construction system according to claim 24 wherein said multi-channel audio system at said order-taking post feeds audio signals to the speaker of each of said table consoles comprising daily food and drink specials, background and dance music and the audio of TV events, live entertainment, fashion shows, lectures and telephone talk shows.

27. A restaurant construction system according to claim 24 wherein each of said table consoles comprises a TV screen and further comprising a video system at said order-taking post which feeds video signals to each of said table consoles.

28. A restaurant construction system according to claim 1 further comprising a TV screen mounted on said order-taking post and extending into said atrium.

29. A restaurant construction system according to claim 1 further comprising a TV screen mounted on said order-taking post and extending into said atrium to display daily food specials and TV events.

30. A restaurant construction system according to claim 1 further comprising a variably translucent partition to separate a private party area from another area, and control means at said order-taking post for varying the amount of translucence of said variably translucent partition.

31. A restaurant construction system according to claim 1 further comprising a computer-controlled environmental control system with its controls at said order-taking post.

32. A restaurant construction system according to claim 1 further comprising a computer-controlled environmental control and smoke removal system with its controls at said order-taking post.

33. A restaurant construction system according to claim 1 further comprising:

(A) a dance floor on a portion of one of said floors; and (B) a movable food buffet bar positioned on said dance floor;

(C) whereby said food buffet bar can be moved from said dance floor to expose said dance floor for dancing.

34. A restaurant construction system according to claim 9 further comprising a porte cochere extending from said entry and adapted to confine arriving cars in an area in which their license plates are in view of said video camera.

35. A restaurant construction system according to claim 1 further comprising a kitchen constructed of four concrete block walls with a concrete block wall abutting the wall of the connecting side of said building so that any fire in the kitchen is slowed from spreading to said building.

36. A restaurant construction system according to claim 6 wherein said entry abuts the connecting side of said building and is constructed of aluminum and glass like the construction of a greenhouse.

37. A restaurant construction system comprising:

(A) a building having a first floor;

(B) a first plurality of tables and chairs with a telephone at each table on said first floor;

(C) said building also having a second floor comprising a terrace supported along three sides of said + building and forming an atrium between said terrace and the fourth side of said building;

(D) a second plurality of tables and chairs with a telephone at each table on said terrace; and (E) an order-taking post supported along the fourth side of said building and extending into said atrium;

(F) whereby an order-taking person in said order-taking post is in view of a plurality of tables on said first floor including those beneath said terrace, and also in view of a plurality of tables on said terrace, so that the order of a patron at a table on either said first floor or said terrace can be taken over the telephone from said order-taking post while the order-taking person is in view of the patron; and (G) a bar on the first floor of said building positioned under said order-taking post.

38. A restaurant construction system according to claim 37 further comprising an entry along the fourth side of said building, said bar on the first floor of said building being positioned directly under said order-taking post and along an outward extension of the fourth side of said building, whereby a patron at said bar can view a patron at said entry.

39. A restaurant construction system according to claim 37 further comprising a combined piano bar and disc jockey stage extending from said bar into said atrium.

40. A restaurant construction system according to claim 37 further comprising a disc jockey stage extending from said bar into said atrium and a dance floor adjacent said disc jockey stage.

41. A restaurant construction system according to claim 40 further comprising dance floor lights mounted on said order-taking post and extending into said atrium and a control system at said order-taking post to control said dance floor lights.

42. A restaurant construction system according to claim 37 further comprising a combined piano bar and disc jockey stage extending from said bar into said atrium, a dance floor abutting said disc jockey stage, dance floor lights mounted on said order-taking post and extending into said atrium and means at said disc jockey stage for controlling said dance floor lights.

43. A restaurant construction system comprising:

(A) a building having a first floor adapted to support tables and chairs;

(B) said building also having a second floor comprising a terrace adapted to support tables and chairs directly over a portion of said first floor and forming an atrium between said terrace and one side of said building; and (C) an order-taking post extending into said atrium and supported above said first floor along said one side of said building at a height providing a direct view of tables and chairs on said terrace and a direct view of tables and chairs on said first floor which are beneath said terrace.

44. A restaurant construction system comprising:

(A) a building having a first floor;

(B) a first plurality of tables and chairs with a telephone at each table on said first floor;

(C) said building also having a second floor comprising a terrace directly over a portion of said first floor and forming an atrium between said terrace and one side of said building;

(D) a second plurality of tables and chairs with a telephone at each table on said terrace; and (E) an order-taking post supported above said first floor along said one side of said building and extending into said atrium;

(F) whereby an order-taking person in said order-taking post is in view of a plurality of tables on said first floor including those beneath said terrace, and also in view of a plurality of tables on said terrace, so that the order of a patron at a table on either said first floor or said terrace can be taken over the telephone from said order-taking post while the order-taking person is in view of the patron.

* * * * *